US012382986B2

(12) United States Patent
Jeong et al.

(10) Patent No.: US 12,382,986 B2
(45) Date of Patent: Aug. 12, 2025

(54) AEROSOL GENERATING DEVICE AND OPERATION METHOD THEREOF

(71) Applicant: KT&G CORPORATION, Daejeon (KR)

(72) Inventors: Min Seok Jeong, Seoul (KR); Jin Chul Jung, Daejeon (KR); Gyoung Min Go, Daejeon (KR); Jang Won Seo, Daejeon (KR); Yong Joon Jang, Daejeon (KR); Chul Ho Jang, Daejeon (KR); Jong Seong Jeong, Sejong (KR)

(73) Assignee: KT&G CORPORATION, Daejeon (KR)

( * ) Notice: Subject to any disclaimer, the term of this patent is extended or adjusted under 35 U.S.C. 154(b) by 653 days.

(21) Appl. No.: 17/259,056

(22) PCT Filed: Sep. 10, 2020

(86) PCT No.: PCT/KR2020/012226
§ 371 (c)(1),
(2) Date: Sep. 16, 2022

(87) PCT Pub. No.: WO2021/071112
PCT Pub. Date: Apr. 15, 2021

(65) Prior Publication Data

US 2023/0014608 A1 Jan. 19, 2023

(30) Foreign Application Priority Data

Oct. 10, 2019 (KR) ..... 10-2019-0125675

(51) Int. Cl.
*A24D 1/20* (2020.01)
*A24F 40/40* (2020.01)
(Continued)

(52) U.S. Cl.
CPC ..... *A24D 1/20* (2020.01); *A24F 40/40* (2020.01); *A24F 40/50* (2020.01); *A24F 40/51* (2020.01)

(58) Field of Classification Search
CPC ..... A24F 40/00; A24F 40/20; A24F 40/50; A24F 47/00; A24F 40/51; A24D 1/20
See application file for complete search history.

(56) References Cited

U.S. PATENT DOCUMENTS 10,827,782 B2 11/2020 Fernando et al.
11,253,003 B2 2/2022 Jeong et al.
(Continued)

FOREIGN PATENT DOCUMENTS

CN 107242606 A 10/2017
CN 108552601 A 9/2018
(Continued)

OTHER PUBLICATIONS

Office Action issued Apr. 18, 2023 in Chinese Application No. 202080005834.5.
(Continued)

*Primary Examiner* — Eric Yaary
*Assistant Examiner* — Ronnie Kirby Jordan
(74) *Attorney, Agent, or Firm* — Sughrue Mion, PLLC

(57) ABSTRACT

An aerosol generating device includes a cavity into which a cigarette is inserted, a light source that emits light to the cigarette inserted in the cavity, a reuse detection sensor that receives light reflected from the cigarette, a heater that heats the cigarette inserted into the cavity, and a controller, and the controller determines whether or not to operate the heater based on a rate of increase or decrease of a sensing value received from the reuse detection sensor.

16 Claims, 12 Drawing Sheets

(51) Int. Cl.
*A24F 40/50* (2020.01)
*A24F 40/51* (2020.01)

(56) References Cited

U.S. PATENT DOCUMENTS

| | | | | |
|---|---|---|---|---|
| 2016/0302488 | A1 | 10/2016 | Fernando et al. | |
| 2017/0055589 | A1* | 3/2017 | Fernando et al. | A24F 47/00 |
| 2019/0261682 | A1 | 8/2019 | Gimkiewicz et al. | |
| 2020/0093185 | A1 | 3/2020 | Lim | |
| 2020/0221773 | A1 | 7/2020 | An | |
| 2020/0260790 | A1 | 8/2020 | Kaufman et al. | |

FOREIGN PATENT DOCUMENTS

| | | | |
|---|---|---|---|
| CN | 110198642 | A | 9/2019 |
| DE | 198 54 008 | A1 | 5/2000 |
| KR | 10-2011-0096548 | A | 8/2011 |
| KR | 10-2016-0124853 | A | 10/2016 |
| KR | 10-2018-0033141 | A | 4/2018 |
| KR | 10-2018-0129637 | A | 12/2018 |
| KR | 10-2019-0049389 | A | 5/2019 |
| KR | 10-2019-0051745 | A | 5/2019 |
| WO | 2019/129378 | A1 | 7/2019 |
| WO | 2019/185747 | A1 | 10/2019 |

OTHER PUBLICATIONS

International Search Report dated Mar. 8, 2021 in International Application No. PCT/KR2020/012226.
Communication dated Feb. 24, 2021 in Korean Application No. 10-2019-0125675.
Extended European Search Report issued Nov. 2, 2021 in European Application No. 20820312.5.

* cited by examiner

AEROSOL GENERATING DEVICE AND OPERATION METHOD THEREOF

TECHNICAL FIELD

The present disclosure relates to an aerosol generating device and an operation method thereof.

BACKGROUND ART

In recent years, there has been an increasing demand for alternative methods for overcoming shortcomings of general cigarettes. For example, there is an increasing demand for a method of generating an aerosol by heating an aerosol generating material, rather than a method of generating an aerosol by burning cigarettes.

When cigarettes that have already been used are heated again by using an aerosol generating device, smoking taste and the amount of atomization of the cigarettes may be reduced, and a burnt taste may be felt. That is, when a reusable cigarette is used, satisfaction that a user feels may be reduced.

Accordingly, there is a need for a technology for preventing reuse of cigarettes.

DESCRIPTION OF EMBODIMENTS

Technical Problem

One or more embodiments provide an aerosol generating device and an operation method thereof. In addition, a computer-readable recording medium is provided in which a program for performing the method on a computer is recorded. Technical problems to be solved by the present embodiment are not limited to the technical problems described above, and other technical problems may be inferred from the following embodiments.

Solution to Problem

According to a first aspect of the present disclosure, an aerosol generating device may include a cavity into which a cigarette is inserted; a light source that emits light to the cigarette inserted in the cavity; a reuse detection sensor that receives light reflected from the cigarette; a heater that heats the cigarette inserted into the cavity; and a controller, and the controller may determine whether or not to operate the heater based on a rate of increase or decrease of a sensing value received from the reuse detection sensor.

In addition, the controller may limit the operation of the heater when the cigarette is determined to be a reused cigarette based on the rate of increase or decrease of the sensing value.

In addition, when the sensing value is increased from a reference value to a first threshold value, decreased to a second threshold value, and increased again to the first threshold value in a predetermined period, the controller may determine that the cigarette is a reused cigarette and limits operation of the heater, and the second threshold value may be determined based on the first threshold value and the rate of increase or decrease rate.

In addition, the cigarette may include a tobacco rod; a front end plug connected to an upstream end of the tobacco rod; and a filter rod connected to a downstream end of the tobacco rod.

In addition, when the sensing value is increased from a reference value to a second threshold value, maintained at the second threshold value, and further increased to the first threshold value in a predetermined period, the controller may determine that the cigarette is a reused cigarette and limits operation of the heater, and the first threshold value may be determined based on the second threshold value and the rate of increase or decrease.

In addition, the cigarette may include a tobacco rod; and a filter rod connected to a downstream end of the tobacco rod.

In addition, the aerosol generating device further includes a cigarette insertion detection switch for detecting whether or not the cigarette is inserted into the cavity, and as the switch detects the cigarette, the controller may control the light source to emit light to the cigarette.

In addition, the light source may be a color LED or an infrared (IR) LED.

In addition, the reuse detection sensor may be a color sensor or an IR proximity sensor.

In addition, the light source, the reuse detection sensor, and the cigarette insertion detection switch may be located around an inlet end of the cavity.

According to a second aspect of the present disclosure, a method of controlling an aerosol generating device may include controlling a light source to emit light to a cigarette inserted into a cavity; receiving light reflected from the cigarette to obtain a sensing value; and determining whether or not to operate a heater based on a rate of increase or decrease of the sensing value.

According to a third aspect of the present disclosure, a computer-readable recording medium may be provided in which a program for performing the method according to the second aspect on a computer is recorded.

ADVANTAGEOUS EFFECTS OF DISCLOSURE

According to the present invention, whether or not a cigarette inserted in a cavity of an aerosol generating device is reused is determined by using a sensing value detected by a reuse detection sensor, and thus, a reused cigarette may be prevented from being reused.

In addition, in the present invention, whether or not a cigarette is reused is determined based on a rate of increase or decrease of a sensing value as well as an absolute value of the sensing value, and thus, whether or not a cigarette is reused may be effectively determined even when the types of the cigarette, a light source, and a reuse detection sensor are changed.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. Hereinafter, embodiments of the present disclosure will be described in detail with reference to the drawings. Hereinafter, embodiments of the present disclosure will be described in detail with reference to the drawings.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 1:
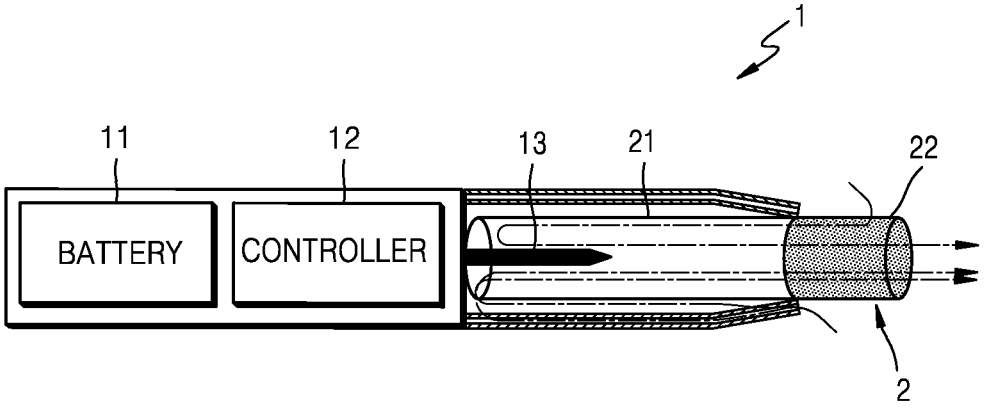
FIGS. 1 to 3 are diagrams showing examples in which a cigarette is inserted into an aerosol generating device.
Figure 2:
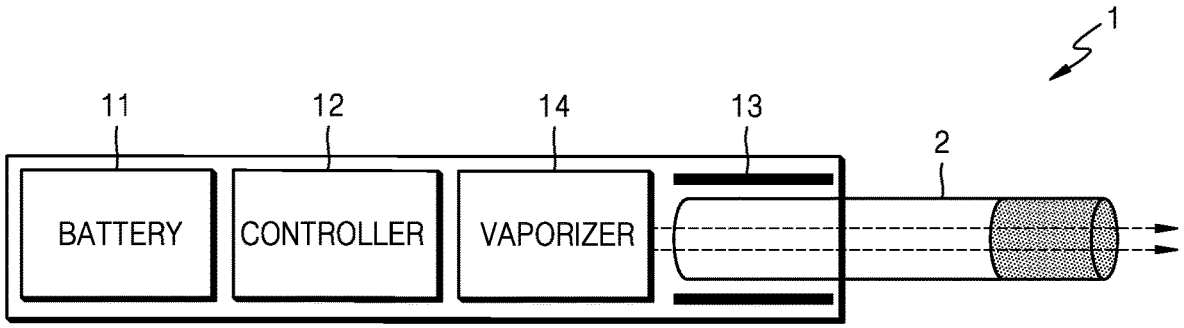
Figure 3:
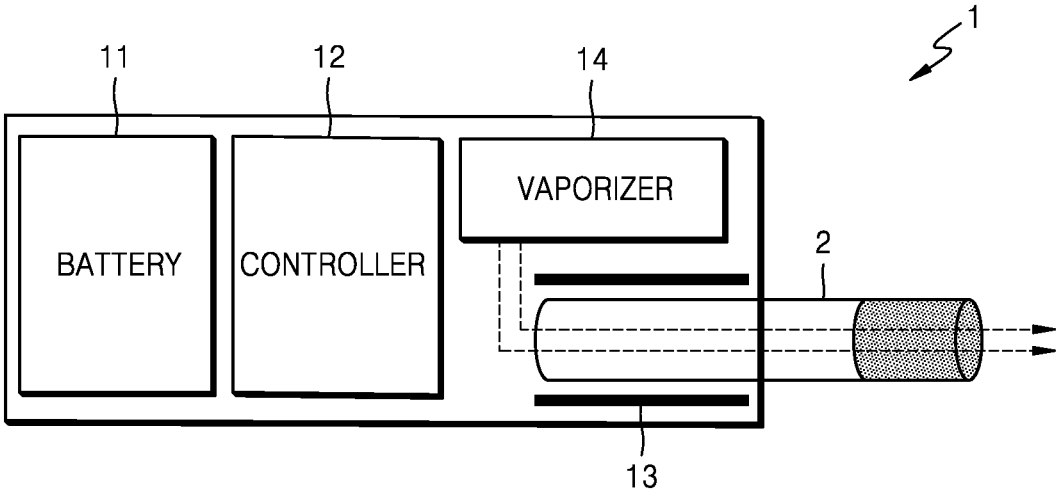

FIGS. 1 through 3 are diagrams showing examples in which a cigarette is inserted into an aerosol generating device.

Referring to FIG. 1, the aerosol generating device 1 may include a battery 11, a controller 12, and a heater 13. Referring to FIGS. 2 and 3, the aerosol generating device 1 may further include a vaporizer 14. Also, the cigarette 2 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other general-purpose components may be further included in the aerosol generating device 1, in addition to the components illustrated in FIGS. 1 through 3.

Also, FIGS. 2 and 3 illustrate that the aerosol generating device 1 includes the heater 13. However, as necessary, the heater 13 may be omitted.

FIG. 1 illustrates that the battery 11, the controller 12, and the heater 13 are arranged in series. Also, FIG. 2 illustrates that the battery 11, the controller 12, the vaporizer 14, and the heater 13 are arranged in series. Also, FIG. 2 illustrates that the battery 11, the controller 12, the vaporizer 14, and the heater 13 are arranged in series. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the cigarette 2 is inserted into the aerosol generating device 1, the aerosol generating device 1 may operate the heater 13 and/or the vaporizer 14 to generate aerosol. The aerosol generated by the heater 13 and/or the vaporizer 14 is delivered to a user by passing through the cigarette 2.

As necessary, even when the cigarette 2 is not inserted into the aerosol generating device 1, the aerosol generating device 1 may heat the heater 13.

The battery 11 supplies power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may generally control operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the cigarette is inserted into the aerosol generating device 1, the heater 13 may be located outside the cigarette. Thus, the heated heater 13 may increase a temperature of an aerosol generating material in the cigarette.

The heater 13 may include an electro-resistive heater. For example, the heater 13 may include an electrically conductive track, and the heater 13 may be heated when currents flow through the electrically conductive track. However, the heater 13 is not limited to the example described above and may include any other heaters which may be heated to a desired temperature. Here, the desired temperature may be pre-set in the aerosol generating device 1 or may be set by a user.

As another example, the heater 13 may include an induction heater. In detail, the heater 13 may include an electrically conductive coil for heating a cigarette in an induction heating method, and the cigarette may include a susceptor which may be heated by the induction heater.

For example, the heater 13 may include a tube-type heating element, a plate-type heating element, a needle-type heating element, or a rod-type heating element, and may heat the inside or the outside of the cigarette 2, according to the shape of the heating element.

Also, the aerosol generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the cigarette 2 to be delivered to a user. In other words, the aerosol generated via the vaporizer 14 may move along an air flow passage of the aerosol generating device 1 and the air flow passage may be configured such that the aerosol generated via the vaporizer 14 passes through the cigarette to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further include general-purpose components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor (a puff detecting sensor, a temperature detecting sensor, a cigarette insertion detecting sensor, etc.). Also, the aerosol generating device 1 may be formed as a structure that, even when the cigarette 2 is inserted into the aerosol generating device 1, may introduce external air or discharge internal air.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated when the cradle and the aerosol generating device 1 are coupled to each other.

A cigarette 2 may be similar to a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The first portion may be completely inserted into the aerosol generating device 1, and the second portion may be exposed to the outside. Alternatively, only a portion of the first portion may be inserted into the aerosol generating device 1, or the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, opening and closing of the air passage and/or a size of the air passage formed in the aerosol generating device 1 may be adjusted by the user. Accordingly, the amount of smoke and a smoking impression may be adjusted by the user. As another example, the external air may flow into the cigarette 2 through at least one hole formed in a surface of the cigarette 2.

Hereinafter, examples of the cigarette 2 will be described with reference to FIGS. 4 and 5.

Figure 4:
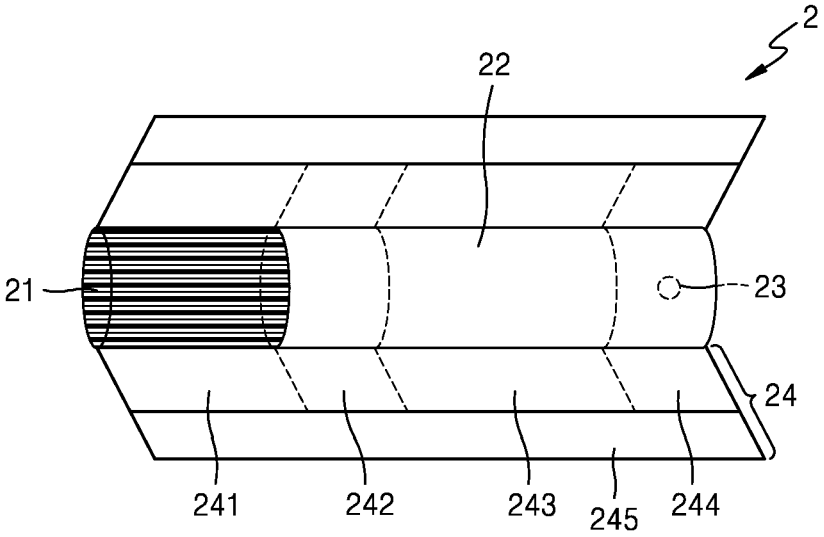
FIGS. 4 and 5 are views showing examples of a cigarette.
Figure 5:
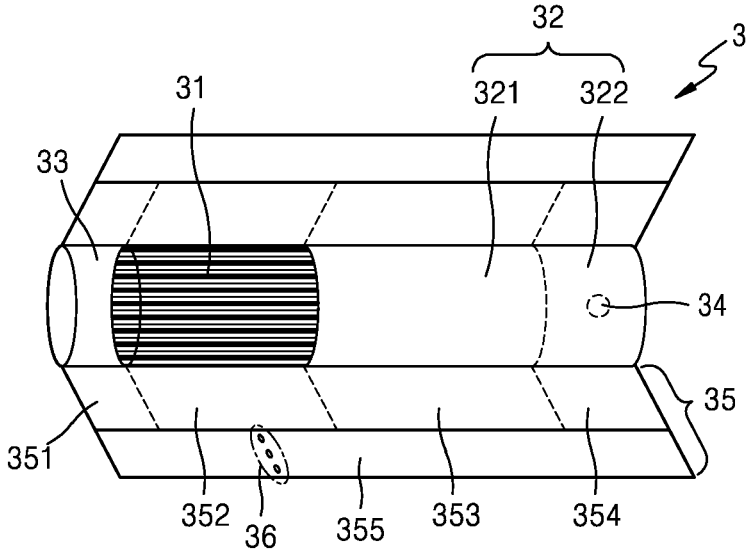

FIGS. 4 and 5 illustrate examples of the cigarette.

Referring to FIG. 4, the cigarette 2 may include a tobacco rod 21 and a filter rod 22. The first portion described above with reference to FIGS. 1 through 3 may include the tobacco rod 21, and the second portion may include the filter rod 22

FIG. 4 illustrates that the filter rod 22 includes a single segment. However, the filter rod 22 is not limited thereto. In other words, the filter rod 22 may include a plurality of segments. For example, the filter rod 22 may include a segment configured to cool an aerosol and a segment configured to filter a certain component included in the aerosol. Also, as necessary, the filter rod 22 may further include at least one segment configured to perform other functions.

The cigarette 2 may be packaged by at least one wrapper 24. The wrapper 24 may have at least one hole through which external air may be introduced or internal air may be discharged. For example, the cigarette 2 may be packaged by one wrapper 24. As another example, the cigarette 2 may be doubly packaged by two or more wrappers 24. For example, the tobacco rod 21 may be packaged by a first wrapper 241, and the filter rod 22 may be packaged by wrappers 242, 243, 244. Also, the entire cigarette 2 may be repackaged by a single wrapper 245. When the filter rod 22 includes a plurality of segments, each segment may be packaged by wrappers 242, 243, 244.

The tobacco rod 21 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which is injected to the tobacco rod 21.

The tobacco rod 21 may be manufactured in various forms. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat-conducting material may be, but is not limited to, a metal foil such as aluminum foil. For example, the heat conductive material surrounding the tobacco rod 21 may uniformly distribute heat transmitted to the tobacco rod 21, and thus, the heat conductivity applied to the tobacco rod may be increased and taste of the tobacco may be improved. Also, the heat conductive material surrounding the tobacco rod 21 may function as a susceptor heated by the induction heater. Here, although not illustrated in the drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

Also, the filter rod 22 may include at least one capsule 23. Here, the capsule 23 may perform a function of generating flavor or aerosol. For example, the capsule 23 may have a configuration in which a liquid containing a flavoring material is wrapped with a film. The capsule 23 may have a spherical or cylindrical shape, but is not limited thereto.

Referring to FIG. 5, the cigarette 3 may further include a front end plug 33. The front end plug 33 may be located on one side of the tobacco rod 31 which is opposite to the filter rod 32. The front end plug 33 may prevent the tobacco rod 31 from being detached outwards and prevent the liquefied aerosol from flowing from the tobacco rod 31 into the aerosol generating device 1 (FIGS. 1 through 3), during smoking.

The filter rod 32 may include a first segment 321 and a second segment 322. Here, the first segment 321 may correspond to the first segment of the filter rod 22 of FIG. 4, and the second segment 322 may correspond to the third segment of the filter rod 22 of FIG. 4.

The diameter and total length of the cigarette 3 may correspond to those of the cigarette 2 of FIG. 4. For example, the length of The front end plug 33 is about 7 mm, the length of the tobacco rod 31 is about 15 mm, the length of the first segment 321 is about 12 mm, and the length of the second segment 322 is about 14 mm, but it is not limited thereto.

The cigarette 2 may be packaged by at least one wrapper 35. The wrapper 35 may have at least one hole through which external air may be introduced or internal air may be discharged. For example, the front end plug 33 may be packaged by a first wrapper 351, the tobacco rod 31 may be packaged by a second wrapper 352, the first segment 321 may be packaged by a third wrapper 353, and the second segment 322 may be packaged by a fourth wrapper 354. Also, the entire cigarette 3 may be repackaged by a fifth wrapper 355.

In addition, at least one perforation 36 may be formed in the fifth wrapper 355. For example, the perforation 36 may be formed in a region surrounding the tobacco rod 31, but is not limited thereto. The perforation 36 may serve to transfer heat generated by the heater 13 illustrated in FIGS. 2 and 3 to the inside of the tobacco rod 31.

In addition, at least one capsule 34 may be included in the second segment 322. Here, the capsule 34 may perform a function of generating flavor or a function of generating aerosol. For example, the capsule 34 may have a configuration in which a liquid containing a flavoring material is wrapped with a film. For example, the capsule 34 may have a spherical or cylindrical shape, but is not limited thereto.

Figure 6A:
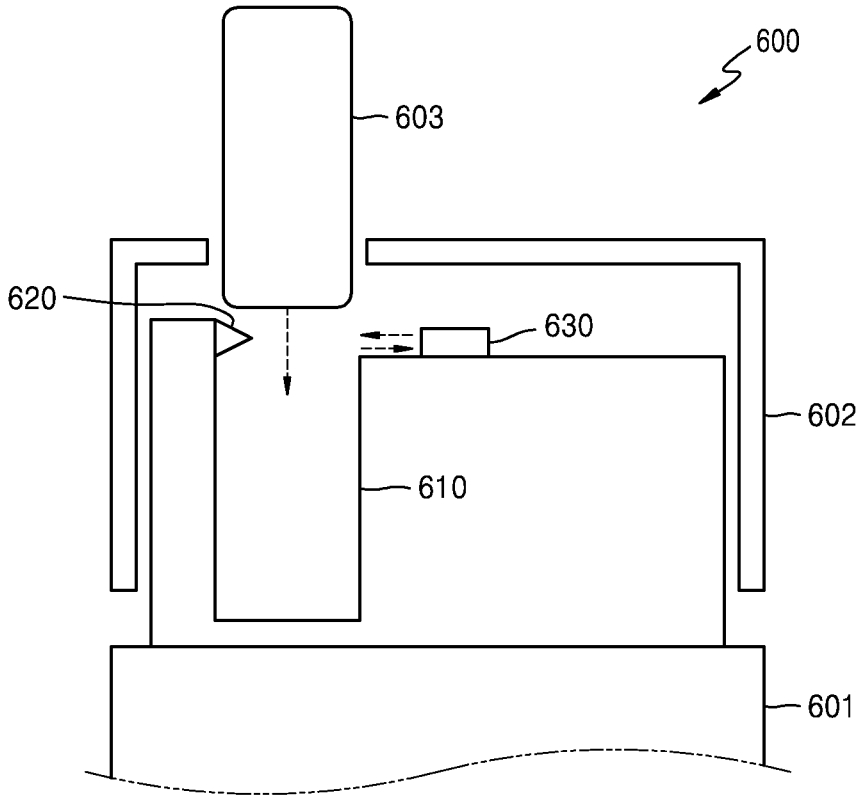
FIGS. 6A and 6B are schematic cross-sectional views of part of an aerosol generating system.
Figure 6B:
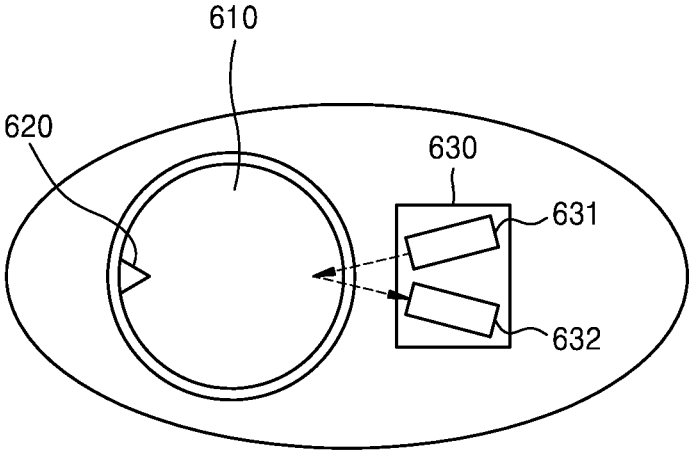

FIGS. 6A and 6B are schematic cross-sectional views of part of an aerosol generation system.

FIG. 6A is a cross-sectional view of an aerosol generating system 600 viewed from the side, and FIG. 6B is a cross-sectional view of the aerosol generating system 600 viewed from above.

Referring to FIGS. 6A and 6B, the aerosol generating system 600 includes an aerosol generating device 601 and 602 and a cigarette 603. The aerosol generating device 601 and 602 includes a body 601 and a cover 602. Meanwhile, the cover 602 and the cigarette 603 may be detachably coupled to the body 601.

A cavity 610 capable of accommodating the cigarette 603 may be formed in the body 601. The cigarette 603 may be accommodated in the cavity 610 through a hole formed in the cover 602. After the cigarette 603 is accommodated in the cavity 610, an aerosol is generated by heating the cigarette 603 with a heater (not shown) located in the cavity 610.

A cigarette insertion detection switch 620 may be located around an inlet end of the cavity 610. The cigarette insertion detection switch 620 may serve to detect whether or not the cigarette 603 is inserted into the cavity 610.

It can be seen that the cigarette 603 is inserted into the cavity 610 based on whether or not the cigarette insertion detection switch 620 operates. For example, in a case the cigarette insertion detection switch 620 is a push switch, the cigarette insertion detection switch 620 may be pushed into the body 601 when the cigarette 603 is inserted into the cavity 610. However, the type of the cigarette insertion detection switch 620 is not limited thereto.

In addition, a sensor module 630 may be located around the inlet end of the cavity 610. The sensor module 630 may include a light source 631 and a reuse detection sensor 632. The sensor module 630 may be spaced apart from a heater by 6 mm or more so as not to be affected by the heater. The cigarette insertion detection switch 620 may be located on the same line as the sensor module 630 or may be at a higher position than the sensor module 630.

When the cigarette insertion detection switch 620 detects that the cigarette 603 is inserted into the cavity 610, the light source 631 may emit light to the cigarette 603. In addition, the reuse detection sensor 632 may receive the light reflected from the cigarette 603.

For example, the light source 631 may include at least one of a red LED, a green LED, a blue LED, and a white LED. In this case, the reuse detection sensor 632 may be a color sensor. Alternatively, the light source 631 may include an infrared (IR) LED. In this case, the reuse detection sensor 632 may be an IR proximity sensor. However, the types of the light source 631 and the reuse detection sensor 632 are not limited thereto.

Meanwhile, the light source 631 and the reuse detection sensor 632 may also be separate configurations without being included in one sensor module 630.

In the present disclosure, whether to reuse the cigarette 603 accommodated in the cavity 610 may be determined by the light source 631 and the reuse detection sensor 632. Details about this will be described below with reference to FIGS. 7 to 9.

Figure 7:
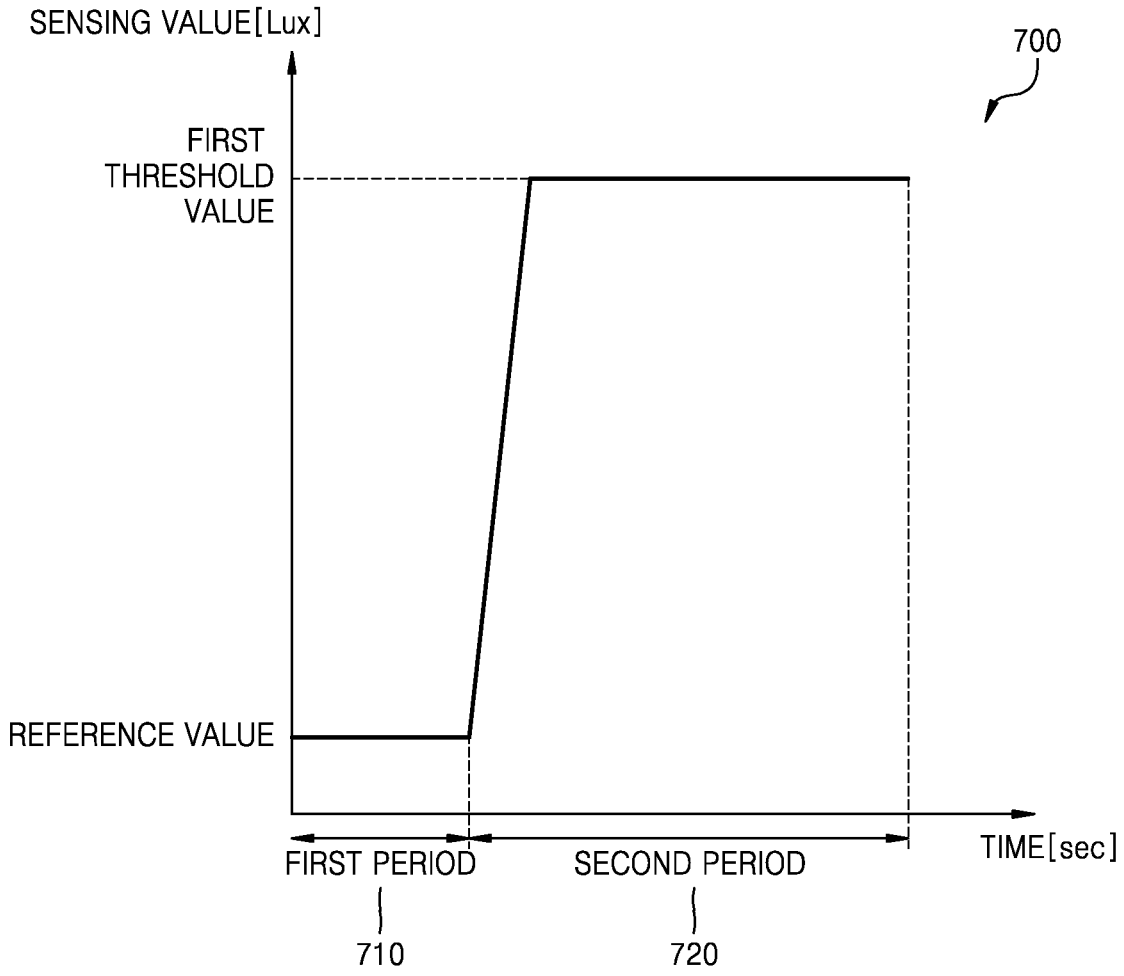
FIG. 7 is a graph showing a sensing value for an unused cigarette, according to an embodiment.

FIG. 7 is a graph showing a sensing value for an unused cigarette according to an embodiment.

Referring to FIG. 7, a graph 700 is a diagram illustrating a sensing value(lux) of a reuse detection sensor over time (sec). Hereinafter, it is assumed that a color (red, green, blue, or white) LED is used as a light source and a color sensor is used as a reuse detection sensor.

The graph 700 may be divided into a first period 710 and a second period 720.

The first period 710 indicates a period before a light source operates (that is, before the light source emits light to a cigarette), and a reuse detection sensor is in a state of not receiving light reflected from the cigarette. Accordingly, a reference value representing a sensing value received by the reuse detection sensor may be a very small value compared to a first threshold value.

The second period 720 indicates a period after the light source operates (that is, after the light source emits light to a cigarette), and the reuse detection sensor is in a state of receiving light reflected from the cigarette.

Specifically, when the cigarette insertion detection switch detects that a cigarette is inserted into a cavity, a light source may emit light to the cigarette and a reuse detection sensor may receive the light reflected from the cigarette.

In general, an unused cigarette is entirely wrapped by wrappers of the same color (for example, white), and thus, the reuse detection sensor may receive a constant sensing value (the first threshold value) over time when the unused cigarette is inserted into the cavity. The first threshold value may be changed depending on the type (red, green, blue, or white) of a color LED used as a light source.

An aerosol generating device may determine that the cigarette accommodated in the cavity is an unused cigarette when the sensing value detected by the reuse detection sensor increases from a reference value to the first threshold value and is maintained at the first threshold value for a predetermined period. For example, when the sensing value increases to 18,000 to 20,000 Lux and is maintained at 18,000 to 20,000 Lux for 1 second, the aerosol generating device may determine that the cigarette accommodated in the cavity is an unused cigarette. However, numerical values of the above-described sensing values is only examples, and various numerical values may be used depending on the types of light sources and reuse detection sensors.

When it is determined that the cigarette accommodated in the cavity is an unused cigarette, the aerosol generating device may start operation of a heater. For example, the aerosol generating device may control power supplied to the heater so that the heater operates in a preheating mode.

Figure 8:
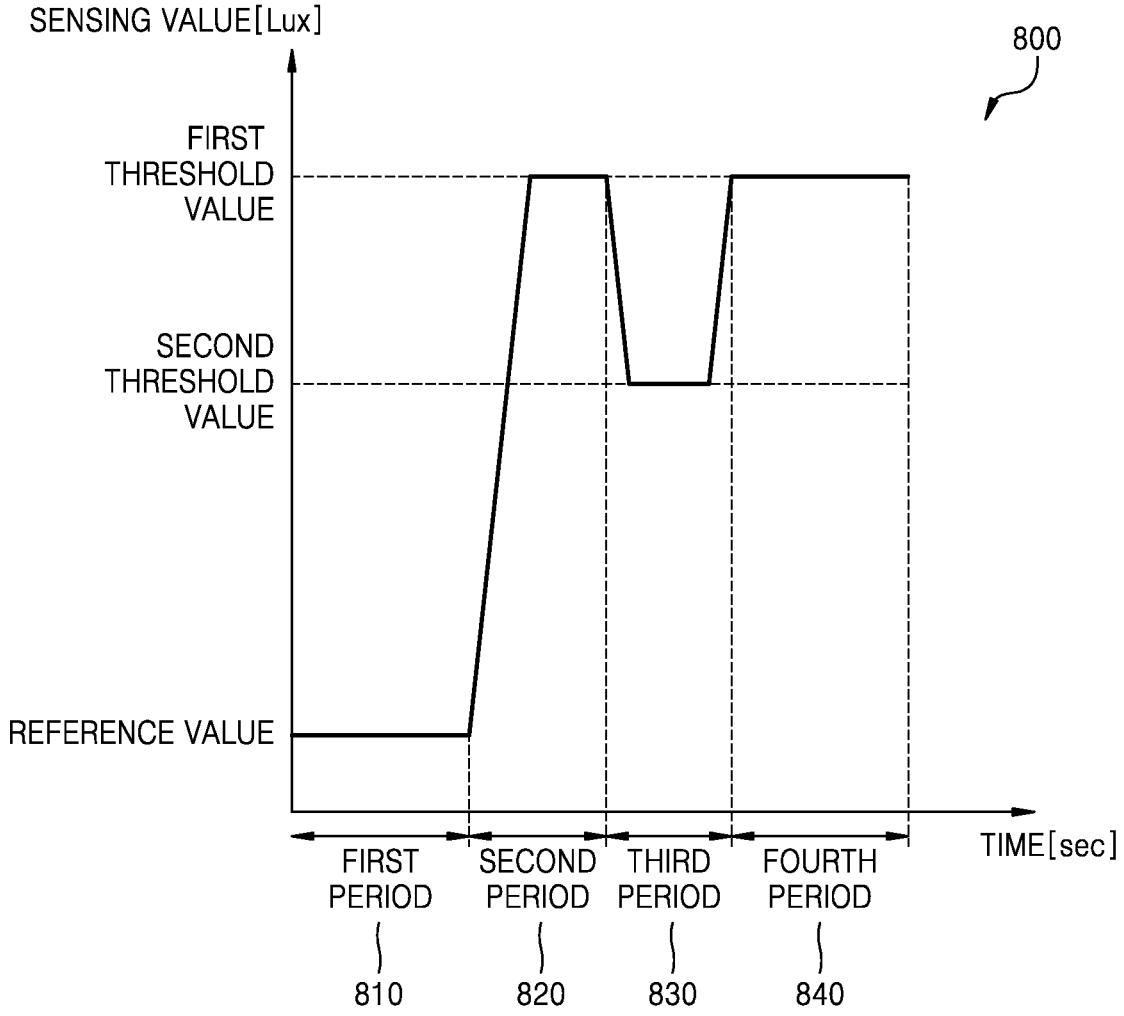
FIG. 8 is a graph showing a sensing value for a reused cigarette according to an embodiment.

FIG. 8 is a graph showing a sensing value for a reused cigarette according to an embodiment.

Referring to FIG. 8, a graph 800 shows a sensing value (lux) of a reuse detection sensor over time (sec). Hereinafter, it is assumed that a color (red, green, blue, or white) LED is used as a light source and a color sensor is used as a reuse detection sensor.

The graph 800 is a diagram showing a sensing value (lux) of the reuse detection sensor over time (sec) when the first cigarette including a front end plug is reused. Specifically, a first cigarette may include a tobacco rod, a front end plug connected to an upstream end of the tobacco rod, and a filter rod connected to a downstream end of the tobacco rod.

The tobacco rod of the first cigarette includes a reconstituted tobacco material including nicotine, an aerosol generating material such as glycerin or propylene glycol, and so on. When the first cigarette is used, a wrapper of a tobacco rod is discolored as components contained in the tobacco rod are vaporized. For example, when the first cigarette is used, a color of the wrapper of the tobacco rod may change from white to yellow. In contrast to this, even when the first cigarette is used, the wrappers of the front end plug and the filter rod may maintain white in the same manner as before use.

A first period 810 indicates a period before the light source operates (that is, before the light source emits light to the cigarette), and the reuse detection sensor is in a state of not receiving the light reflected from the cigarette. Accordingly, the reference value representing the sensing value received by the reuse detection sensor may be a value that is very small compared to the first threshold value and the second threshold value.

A second period 820 to a fourth period 840 indicate periods after the light source operates (that is, after the light source emits light to the cigarette), and are in a state in which a reuse detection sensor receives light reflected from the cigarette.

Specifically, when the cigarette insertion detection switch detects that the cigarette is inserted into the cavity, the light source may emit light to the cigarette, and the reuse detection sensor may receive the light reflected from the cigarette.

The first cigarette is inserted into the cavity of the aerosol generating device in the order of the front end plug, the cigarette rod and the filter rod, and the reuse detection sensor may receive the light reflected by each segment in the order of the front end plug, the cigarette rod, and the filter rod of the first cigarette.

Referring to FIG. 8, the second period 820 is a period in which the reuse detection sensor senses the light reflected by the front end plug, and the third period 830 is a period in which the reuse detection sensor detects the light reflected by the cigarette rod, and the fourth period 840 is a period in which the reuse detection sensor senses the light reflected by the filter rod.

As described above, even when the first cigarette is used, a wrapper of the front end plug maintains white, and thus, the sensing value detected by the reuse detection sensor may increase from the reference value to the first threshold value. For example, the sensing value may increase from a reference value less than or equal to 200 Lux to 18,000 to 20,000 Lux.

Meanwhile, the cigarette rod is connected to a downstream end of the front end plug, and when the first cigarette is used, a color of the wrapper of the cigarette rod is changed (for example, changed from white to yellow), and thus, the sensing value detected by the reuse detection sensor may be decreased from the first threshold value to the second threshold value.

In one embodiment, the second threshold value may be determined by the first threshold value and a preset reduction rate. For example, when the first threshold value is 18,000 to 20,000 Lux and the preset reduction rate is 30%, the second threshold value may be determined to be 12,600 to 14,000 Lux.

The filter rod is connected to a downstream end of the cigarette rod, and even when the first cigarette is used, a wrapper of the filter rod maintains white in the same manner as the front end plug, and thus, the sensing value detected by the reuse detection sensor may be increased from the second threshold value to the first threshold value again. For example, the sensing value may be increased from 12,600 to 16,000 Lux to 18,000 to 20,000 Lux.

When the sensing value detected by the reuse detection sensor is increased from the reference value to the first threshold value, decreased to the second threshold value, and then increased again to the first threshold value in a predetermined period, the aerosol generating device may determine that the cigarette accommodated in the cavity is a reused cigarette. When it is determined that the cigarette accommodated in the cavity is a reused cigarette, the aerosol generating device may limit operation of the heater.

For example, when the sensing value is increased to 18,000 to 20,000 Lux, decreased to 12,600 to 14,000 Lux, and then increased again to 18,000 to 20,000 Lux within 1 second, the aerosol generating device may determine that the cigarette accommodated in the cavity is a reused cigarette.

However, the numerical values and the reduction rates of the sensing value described above are only examples, and various numerical values may be used according to the types of light sources and reuse detection sensors.

In the present disclosure, by determining whether or not a cigarette inserted in a cavity of an aerosol generating device is reused by using a sensing value detected by a reuse detection sensor, and thus, a reused cigarette may be prevented from being used. In addition, in the present disclosure, by determining whether or not a cigarette is reused based on a rate of increase or decrease of a sensing value as well as an absolute value of the sensing value, whether or not a cigarette is reused may be effectively determined even when the types of the cigarette, a light source, and a reuse detection sensor are changed.

Figure 9:
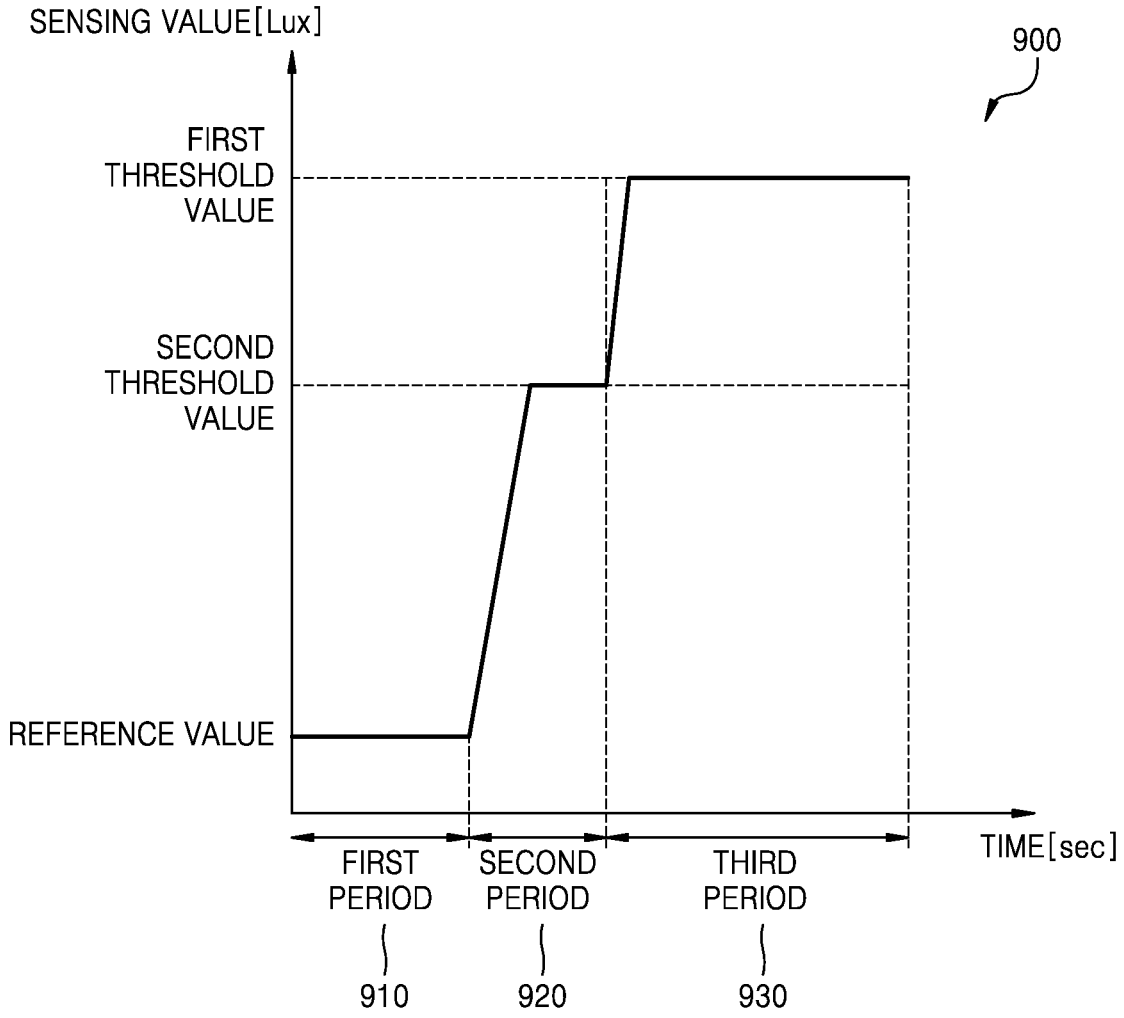
FIG. 9 is a graph showing a sensing value for a reused cigarette according to an embodiment.

FIG. 9 is a graph showing a sensing value for a reused cigarette according to an embodiment.

Referring to FIG. 9, a graph 900 shows a sensing value (lux) of a reuse detection sensor over time (sec). Hereinafter, it is assumed that a color (red, green, blue, or white) LED is used as a light source and a color sensor is used as a reuse detection sensor.

The graph 800 showing the sensing value (lux) of the reuse detection sensor over time (sec) when a second cigarette not including a front end plug is reused. Specifically, the second cigarette may include a tobacco rod and a filter rod connected to a downstream end of the tobacco rod.

The tobacco rod of the second cigarette may include a reconstituted tobacco material including nicotine, an aerosol generating material such as glycerin or propylene glycol, and so on. When the second cigarette is used, a wrapper of a tobacco rod is discolored as components contained in the tobacco rod are vaporized. For example, when the second cigarette is used, a color of a wrapper of the tobacco rod may change from white to yellow. In contrast to this, even when the second cigarette is used, the wrappers of the filter rod may maintain white in the same manner as before use.

A first period 910 is a period indicating a state before the light source operates (that is, before the light source emits light to the cigarette), and the reuse detection sensor is in a state of not receiving the light reflected from the cigarette. Accordingly, the reference value representing the sensing value received by the reuse detection sensor may be a very small value compared to the first threshold value and the second threshold value.

A second period 920 to a third period 930 indicate periods after the light source operates (that is, after the light source emits light to the cigarette), and are in a state in which the reuse detection sensor receives light reflected from the cigarette.

Specifically, when the cigarette insertion detection switch detects that the cigarette is inserted into the cavity, the light source may emit light to the cigarette, and the reuse detection sensor may receive the light reflected from the cigarette.

The second cigarette is inserted into the cavity of the aerosol generating device in the order of the cigarette rod and the filter rod, and the reuse detection sensor may receive the light reflected by each segment in the order of the cigarette rod and the filter rod of the second cigarette.

Referring to FIG. 9, the second period 920 is a period in which the reuse detection sensor senses the light reflected by the cigarette rod, and a third period 930 is a period in which the reuse detection sensor senses the light reflected by the filter rod.

As described above, when the second cigarette is used, a color of the wrapper of the tobacco rod is changed (for example, changed from white to yellow), and thus, the sensing value detected by the reuse detection sensor may increase from the reference value to the second threshold value. For example, the sensing value may increase from a reference value less than or equal to 200 Lux to 8,000 to 10,000 Lux.

In contrast to this, the filter rod is connected to a downstream end of the cigarette rod, and a wrapper of the filter rod maintains white even when the first cigarette is used, and thus, the sensing value detected by the reuse detection sensor may increase from the second threshold value to the first threshold value.

In one embodiment, the first threshold value may be determined by the second threshold value and a preset increase rate. For example, when the second threshold value is 8,000 to 10,000 Lux and the preset increase rate is 200%, the second threshold value may be determined to be 16,000 to 20,000 Lux.

When the sensing value detected by the reuse detection sensor is increased from the reference value to the second threshold value, maintained at the second threshold value, and then further increased to the first threshold value in a predetermined period, the aerosol generating device may determine that the cigarette accommodated in the cavity is a reused cigarette. When it is determined that the cigarette accommodated in the cavity is a reused cigarette, the aerosol generating device may limit operation of the heater.

For example, when the sensing value is increased to 8,000 to 10,000 Lux, maintained at 8,000 to 10,000 Lux, and then further increased to 16,000 to 20,000 Lux within 1 second, the aerosol generating device may determine that the cigarette accommodated in the cavity is a reused cigarette.

Meanwhile, when the sensing value detected by the reuse detection sensor is increased from a reference value to the second threshold value, increased directly from the reference value to the first threshold value without a period (that is, the second period 920) in which the sensing value is maintained at the second threshold value, and maintained at the first threshold value for a period, the aerosol generating device may determine that the cigarette accommodated in the cavity is an unused cigarette.

However, the numerical values and the reduction rates of the sensing value described above are only examples, and various numerical values may be used according to the types of light sources and reuse detection sensors.

In the present disclosure, by determining whether or not a cigarette inserted in a cavity of an aerosol generating device is reused by using a sensing value detected by a reuse detection sensor, a reused cigarette may be prevented from being used. In addition, in the present disclosure, by determining whether or not to a cigarette is reused is determined based on a rate of increase or decrease of a sensing value as well as an absolute value of the sensing value, whether or not a cigarette is reused may be effectively determined even when the types of the cigarette, a light source, and a reuse detection sensor are changed.

Figure 10:
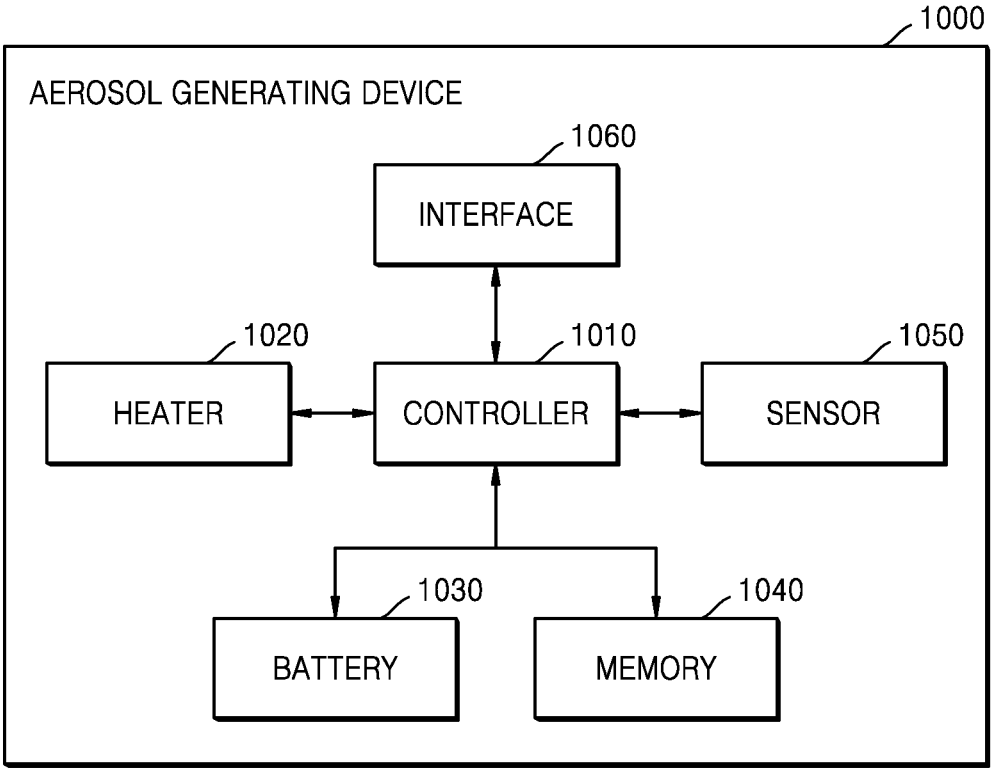
FIG. 10 is a block diagram showing a hardware configuration of an aerosol generating device according to an embodiment.

FIG. 10 is a block diagram showing a hardware configuration of an aerosol generating device according to an embodiment.

Referring to FIG. 10, an aerosol generating device 1000 may include a controller 1010, a heater 1020, a battery 1030, a memory 1040, a sensor 1050, and an interface 1060. However, an internal structure of the aerosol generating device 1000 is not limited to the structures shown in FIG. 10. It may be understood by those skilled in the art related to the present embodiment that part of the hardware configurations shown in FIG. 10 may be omitted or new components may be added according to design of the aerosol generating device 1000.

The heater 1020 is electrically heated by power supplied from the battery 1030 under the control of the controller 1010. The heater 1020 is located inside an accommodation passage of the aerosol generating device 1000 for accommodating a cigarette. As the cigarette is inserted through an insertion hole of the aerosol generating device 1000 from the outside and moves along the accommodation passage, one end of the cigarette may be inserted into the heater 1020. Accordingly, the heated heater 1020 may increase a temperature of an aerosol generating material of the cigarette. The heater 1020 may be applicable without limitation as long as the heater may be inserted into the cigarette.

The heater 1020 may include a heat source and a heat transfer member. For example, the heat source of the heater 1020 may be made in a film shape having an electrical resistive pattern, and the heater 1020 of a film shape may be arranged to surround at least a portion of an outer surface of the heat transfer member (for example, a heat transfer tube).

The heat transfer tube may include a metal material capable of transferring heat, such as aluminum or stainless steel, or may include an alloy material, carbon, a ceramic material, or so on. When power is supplied to the electrical resistive pattern of the heater 1020, heat is generated, and the generated heat may heat the aerosol generating material through the heat transfer tube.

The aerosol generating device 1000 may include a separate temperature sensor. Alternatively, instead of providing the separate temperature sensor, the heater 1020 may also serve as a temperature sensor. Alternatively, while the heater 1020 serves as a temperature sensor, a separate temperature sensor may be further included in the aerosol generating device 1000. The temperature sensor may be arranged on the heater 1020 in the form of a conductive track or an element.

For example, when a voltage applied to the temperature sensor and a current flowing through the temperature sensor are measured, resistance R may be determined. In this case, the temperature sensor may measure a temperature T according to Equation 1 below.

$$R=R_0(1+\alpha(T-T_0)) \quad \text{[Equation 1]}$$

In Equation 1, R denotes a current resistance value of the temperature sensor, R0 denotes a resistance value at a temperature T0 (for example, 0° C.), and a denotes a resistance temperature coefficient of the temperature sensor. Because a conductive material (for example, metal) has a unique resistance temperature coefficient, a may be determined in advance according to the conductive material constituting the temperature sensor. Accordingly, when the resistance R of the temperature sensor is determined, the temperature T of the temperature sensor may be calculated by Equation 1.

The controller 1010 is hardware that controls the overall operation of the aerosol generating device 1000. The controller 1010 is a microprocessor and is an integrated circuit implemented as a processing unit such as a microcontroller.

The controller 1010 analyzes results detected by the sensor 1050 and controls subsequent processing to be performed. The controller 1010 may start or stop supplying power from the battery 1030 to the heater 1020 according to the detected results. In addition, the controller 1010 may control the amount of power supplied to the heater 1020 and a time at which the power is supplied so that the heater 1020 may be heated to a predetermined temperature or maintain an appropriate temperature. Furthermore, the controller 1010 may process various types of input information and output information of the interface 1060.

The controller 1010 may count the number of smoking of a user using the aerosol generating device 1000 and control functions of the aerosol generating device 1000 related thereto to limit smoking of the user according to a counting result.

The memory 1040, as a hardware component configured to store various pieces of data processed by the aerosol generating device 1000, may store data processed or to be processed by the controller 1010. The memory 1040 may be implemented with various types of memories; random access memory (RAM), such as dynamic random access memory (DRAM) and static random access memory (SRAM), etc.; read-only memory (ROM); electrically erasable programmable read-only memory (EEPROM), and so on.

The memory 1040 may store data on a smoking pattern of a user, such as smoking time and smoking frequency. In addition, the memory 1040 may store data related to a reference temperature change value when a cigarette is accommodated in the accommodation passage.

In addition, the memory 1040 may store a plurality of temperature correction algorithms.

The battery 1030 supplies power to be used for the aerosol generating device 1000 to operate. That is, the battery 1030 may supply power to heat the heater 1020. In addition, the battery 1030 may supply power required for operating other hardware, the controller 1010, the sensor 1050, and the interface 1060, which are included in the aerosol generating device 1000. The battery 1030 may be a lithium iron phosphate (LiFePO4) battery but is not limited thereto and may be a lithium cobalt oxide (LiCoO2) battery, a lithium titanate battery, or so on. The battery 1030 may be a rechargeable battery or a disposable battery.

The sensor 1050 may include a variety of sensors, such as a puff detect sensor (a temperature sensor a flow detection sensor, a position detection sensor, or so on), a cigarette insertion detection sensor, a temperature sensor of the heater 1020, a cigarette reuse detection sensor and so on. Results detected by the sensor 1050 may be transmitted to the controller 1010, and the controller 1010 may control the aerosol generating device 1000 to perform various functions such as temperature control of a heater, limitation of smoking, determination of whether or not a cigarette is inserted, display of notification, and whether or not a cigarette is reused, according to the sensing result.

The interface 1060 may include various interfacing means such as a display or a lamp that outputs visual information, a motor that outputs haptic information, a speaker that outputs sound information, input/output (I/O) interfacing means (for example, a button and a touch screen) that receives information input from a user or outputs information to a user, terminals that perform data communication or receive charging power, and communication interfacing modules that perform wireless communication (for example, Wi-Fi, Wi-Fi Direct, Bluetooth, near-field communication (NFC), and so on) with an external device. However, the aerosol generating device 1000 may be implemented by selecting only part of the various interfacing means described above.

Meanwhile, the aerosol generating device 1000 may further include a vaporizer (not shown). The vaporizer (not shown) may include a liquid storage, a liquid delivery element, and a heating element for heating a liquid.

The liquid storage may store a liquid composition. For example, the liquid composition may be a liquid containing a tobacco-containing material including volatile tobacco flavor component or may also be a liquid including a non-tobacco material. The liquid storage may also be made to be detachable from and attachable to a vaporizer (not shown) or may also be made integrally with the vaporizer (not shown).

For example, the liquid composition may include water, a solvent, ethanol, plant extract, spices, flavorings, or a vitamin mixture. The spices may include menthol, peppermint, spearmint oil, various fruit-flavored ingredients, and so on but are not limited thereto. The flavorings may include ingredients capable of providing various flavors or savors to a user. The vitamin mixture may be a mixture of at least one of vitamin A, vitamin B, vitamin C, and vitamin E, but is not limited thereto. In addition, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or so on but is not limited thereto. Further, the heating element may be composed of a conductive filament such as a nichrome wire and may be arranged as being a structure wound around the liquid delivery element. The heating element may be heated by a supplied electric current and may heat the liquid composition by transferring heat to the liquid composition in contact with the heating element. As a result, aerosol may be generated.

For example, the vaporizer (not shown) may be referred to as a cartomizer or an atomizer, but is not limited thereto.

Figure 11:
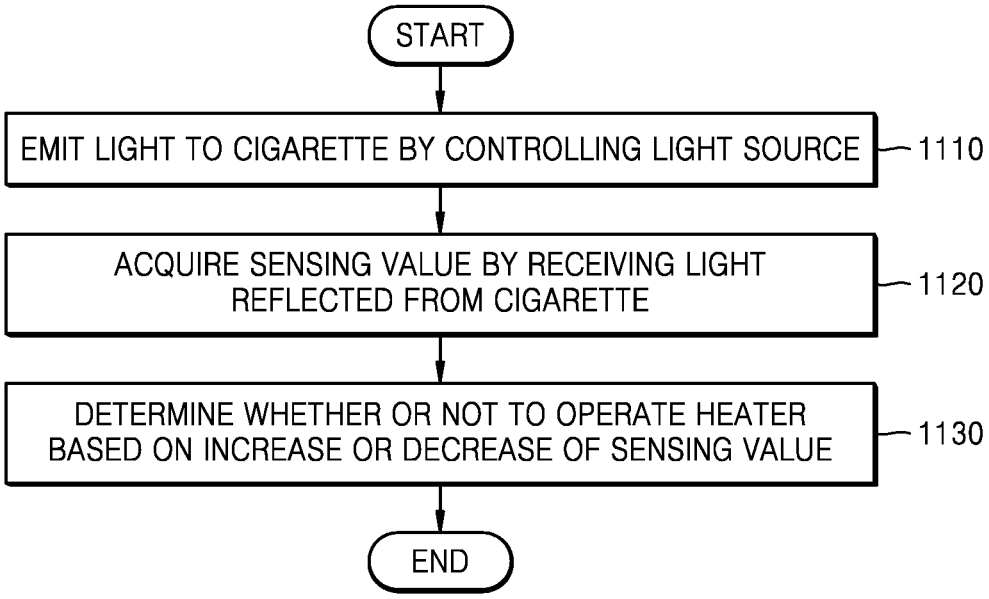
FIG. 11 is a flowchart showing a method of controlling an aerosol generating device according to an embodiment.

FIG. 11 is a flowchart showing a method of controlling an aerosol generating device according to an embodiment.

Referring to FIG. 11, the aerosol generating device may control a light source to emit light to the cigarette in step 1110.

The light source may be located around an inlet end of a cavity in the aerosol generating device in which a cigarette is accommodated. The light source may be arranged so that light may be emit to the cigarette inserted into the cavity. For example, the light source may be a color LED, an IR LED, or so on but is not limited thereto.

In one embodiment, when a cigarette insertion detection switch detects that the cigarette is inserted into the cavity, the aerosol generating device may control the light source to emit light to the cigarette. For example, when the cigarette insertion detection switch is a push switch, the cigarette insertion detection switch may be pushed into a body when the cigarette is inserted into the cavity. When the cigarette insertion detection switch is pushed into the body, the aerosol generating device may detect that the cigarette is inserted into the cavity and control the light source to emit light to the cigarette.

In step 1120, the aerosol generating device may acquire a sensing value by receiving light reflected from the cigarette.

A reuse detection sensor may be located around the inlet end of the cavity in the aerosol generating device in which the cigarette is accommodated. The reuse detection sensor may be arranged to receive the light reflected from the cigarette. For example, the reuse detection sensor may be a color sensor, an IR proximity sensor, or so on but is not limited thereto.

Meanwhile, the light source and the reuse detection sensor may be mounted on one sensor module. Alternatively, the light source and the reuse detection sensor may also have separate and independent configurations without being mounted on the one sensor module.

In step 1130, the aerosol generating device may determine whether or not to operate a heater based on a rate of increase or decrease of the sensing value.

In one embodiment, a first cigarette may be inserted into the aerosol generating device. The first cigarette may include a tobacco rod, a front end plug connected to an upstream end of the tobacco rod, and a filter rod connected to a downstream end of the tobacco rod.

When the first cigarette is used, a wrapper of a tobacco rod is discolored as components contained in the tobacco rod are vaporized. For example, when the first cigarette is used, a color of the wrapper of the tobacco rod may change from white to yellow. In contrast to this, even when the first cigarette is used, the wrappers of the front end plug and the filter rod may maintain white in the same manner as before use.

When the sensing value detected by the reuse detection sensor is increased from the reference value to the first threshold value, decreased to the second threshold value, and then increased again to the first threshold value in a predetermined period, the aerosol generating device may determine that the cigarette accommodated in the cavity is a reused cigarette. When it is determined that the first cigarette accommodated in the cavity is a reused cigarette, the aerosol generating device may limit operation of the heater.

For example, when the sensing value is increased from a reference value less than or equal to 200 Lux to 18,000 to 20,000 Lux, decreased to 12,600 to 14,000 Lux, and increased again to 18,000 to 20,000 Lux within 1 second, the aerosol generating device may determine that the first cigarette is a reused cigarette.

In another embodiment, a second cigarette may be inserted into the aerosol generating device. The second cigarette may include a tobacco rod and a filter rod connected to a downstream end of the tobacco rod.

When the second cigarette is used, a wrapper of a tobacco rod is discolored as components contained in the tobacco rod are vaporized. For example, when the second cigarette is used, a color of a wrapper of the tobacco rod may change from white to yellow. In contrast to this, even when the second cigarette is used, a wrapper of the filter rod may maintain white in the same manner as before use.

When the sensing value detected by the reuse detection sensor is increased from the reference value to the second threshold value, maintained at the second threshold value, and then further increased to the first threshold value in a predetermined period, the aerosol generating device may determine that the second cigarette accommodated in the cavity is a reused cigarette. When it is determined that the second cigarette accommodated in the cavity is a reused cigarette, the aerosol generating device may limit operation of the heater.

For example, when the sensing value is increased from a reference value less than or equal to 200 Lux to 8,000 to 10,000 Lux, maintained at 8,000 to 10,000 Lux, and further increased to 16,000 to 20,000 Lux within 1 second, the aerosol generating device may determine that the second cigarette is a reused cigarette.

One embodiment may also be implemented in the form of a recording medium including instructions executable by a computer, such as a program module executable by the computer. A computer-readable medium may be any available medium that can be accessed by a computer and includes both volatile and nonvolatile media, and removable and non-removable media. In addition, the computer-readable medium may include both a computer storage medium and a communication medium. The computer storage medium includes all of volatile and nonvolatile, and removable and non-removable media implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer media.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol generating device comprising:

a cavity into which a cigarette is inserted;

a light source that emits light to the cigarette inserted in the cavity;

a reuse detection sensor that receives light reflected from the cigarette;

a heater that heats the cigarette inserted into the cavity; and a controller, wherein the controller determines whether or not to operate the heater based on whether a rate of a change of a sensing value over time received from the reuse detection sensor conforms to a pre-defined pattern of the rate of the change over time, which is non-linear.

2. The aerosol generating device of claim 1, wherein the controller limits operation of the heater when the cigarette is determined to be a reused cigarette based on whether a rate of an increase and/or a decrease of the sensing value conforms to the pre-defined pattern.

3. The aerosol generating device of claim 1, wherein, when the sensing value is increased from a reference value to a first threshold value, decreased to a second threshold value, and increased again to the first threshold value in a predetermined period, the controller determines that the cigarette is a reused cigarette and limits operation of the heater, and wherein the second threshold value is determined by applying a preset reduction rate to the first threshold value.

4. The aerosol generating device of claim 3, wherein the cigarette comprises:

a tobacco rod;

a front end plug connected to an upstream end of the tobacco rod; and a filter rod connected to a downstream end of the tobacco rod.

5. The aerosol generating device of claim 1, wherein, when the sensing value is increased from a reference value to a second threshold value, maintained at the second threshold value, and further increased to a first threshold value in a predetermined period, the controller determines that the cigarette is a reused cigarette and limits operation of the heater, and wherein the first threshold value is determined by applying a preset increase rate to the second threshold value.

6. The aerosol generating device of claim 3, wherein the cigarette comprises:

a tobacco rod; and a filter rod connected to a downstream end of the tobacco rod.

7. The aerosol generating device of claim 1, wherein the aerosol generating device further comprises a cigarette insertion detection switch for detecting whether or not the cigarette is inserted into the cavity, and wherein, as the cigarette insertion detection switch detects the cigarette, the controller controls the light source to emit light to the cigarette.

8. The aerosol generating device of claim 1, wherein the light source is a color LED or an infrared (IR) LED.

9. The aerosol generating device of claim 1, wherein the reuse detection sensor is a color sensor or an IR proximity sensor.

10. The aerosol generating device of claim 7, wherein the light source, the reuse detection sensor, and the cigarette insertion detection switch are located around an inlet end of the cavity.

11. The aerosol generating device of claim 1, wherein the controller is configured to emit light to the cigarette when the cigarette is inserted into the cavity.

12. A method of using an aerosol generating device including a cavity into which a cigarette is inserted; a light source that emits light to the cigarette inserted in the cavity; a reuse detection sensor that receives light reflected from the cigarette; a heater that heats the cigarette inserted into the cavity; and a controller, the method comprising:

controlling the light source to emit light to the cigarette inserted into the cavity;

receiving, by using the reuse detection sensor, light reflected from the cigarette to obtain a sensing value; and determining, by using the controller, whether or not to operate the heater based on whether a rate of a change of the sensing value over time received from the reuse detection sensor conforms to a pre-defined pattern of the rate of the change over time, which is non-linear.

13. The method of claim 12, wherein the determining of whether or not to operate the heater comprises limiting operation of the heater when the cigarette is determined to be a reused cigarette based on whether a rate of an increase and/or a decrease of the sensing value conforms to the pre-defined pattern.

14. The method of claim 12, wherein the determining of whether or not to operate the heater comprises determining that the cigarette is a reused cigarette when the sensing value is increased from a reference value to a first threshold value, decreased to a second threshold value, and increased again to the first threshold value for a predetermined period, and limiting operation of the heater, and wherein the second threshold value is determined by applying a preset reduction rate to the first threshold value.

15. The method of claim 12, wherein the determining of whether or not to operate the heater comprises determining the cigarette as a reused cigarette when the sensing value is increased from a reference value to a second threshold value, maintained at the second threshold value, and increased to a first threshold value for a predetermined period, and limiting operation of the heater, and wherein the first threshold value is determined by applying a preset increase rate to the second threshold value.

16. The method of claim 12, wherein the emitting the light to the cigarette comprises:

detecting whether or not the cigarette is inserted into the cavity by using a switch; and controlling the light source to emit light to the cigarette in response to the detection of the cigarette.

* * * * *